United States Patent [19]

Mack

[11] 4,216,632

[45] Aug. 12, 1980

[54] SUPPORT MEMBER AND METHOD OF MANUFACTURE

[75] Inventor: Grant V. Mack, Richmond, Va.

[73] Assignee: Reynolds International, Inc., Richmond, Va.

[21] Appl. No.: 950,355

[22] Filed: Oct. 11, 1978

[51] Int. Cl.[3] ..... E04H 12/08

[52] U.S. Cl. ..... 52/40; 52/732

[58] Field of Search ..... 248/121, 153; 52/730–732, 301, 726, 727, 40, 722, 725; 362/403, 45; 114/90, 105

[56] References Cited

U.S. PATENT DOCUMENTS

| | | | |
|---|---|---|---|
| 765,054 | 7/1904 | Tafel | 52/40 |
| 933,854 | 9/1909 | Sciple | 52/301 |
| 1,994,716 | 3/1935 | Klemperer | 52/731 |
| 2,664,977 | 1/1954 | Starcevich | 52/301 |
| 2,790,524 | 4/1957 | Herrschaft | 52/731 |
| 3,187,175 | 6/1965 | Lang | 240/84 |
| 3,276,182 | 10/1966 | Handley | 52/731 |
| 3,372,518 | 3/1968 | Rensch | 52/263 |
| 3,374,593 | 3/1968 | Rensch | 52/283 |
| 3,706,169 | 12/1972 | Rensch | 52/263 |
| 3,728,837 | 4/1973 | Kiefer | 52/732 |

FOREIGN PATENT DOCUMENTS

| | | | |
|---|---|---|---|
| 1363195 | 5/1954 | France | 52/732 |

*Primary Examiner*—James L. Ridgill, Jr.

*Attorney, Agent, or Firm*—Griffin, Branigan & Butler

[57] ABSTRACT

A tapered support member for disparate articles is assembled from elongated, strip-like sections that form an open frame when joined by a plurality of separator fasteners which progressively space the sections further apart along the member's longitudinal axis. The frame is closed by tapered, wedge-shaped fairing inserts adapted to engage slots formed along each longitudinal edge of the strip-like sections; and a cap and base are positioned accordingly to complete the construction of the support member. Alternatively a non-tapered support structure may be constructed when the separator-fasteners space the sections equally along the entire longitudinal axis of the member. Each component part of the support member is structured so that extrusion techniques can be used to produce the component parts.

12 Claims, 13 Drawing Figures

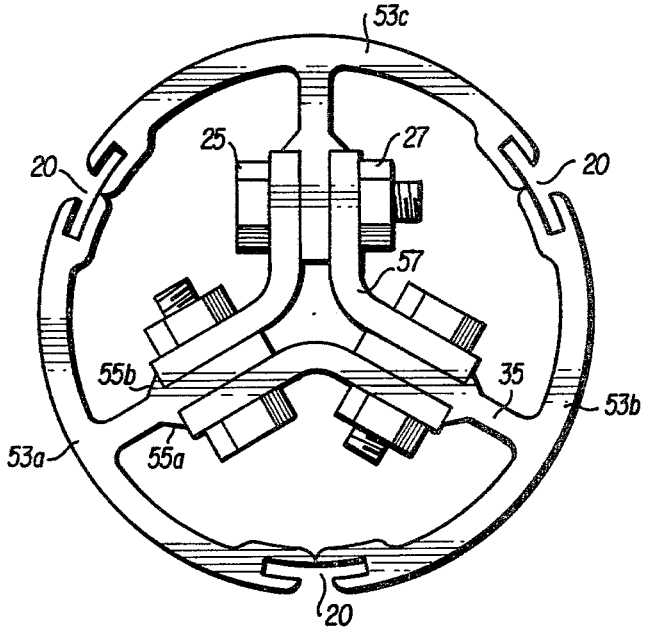
Fig. 8C
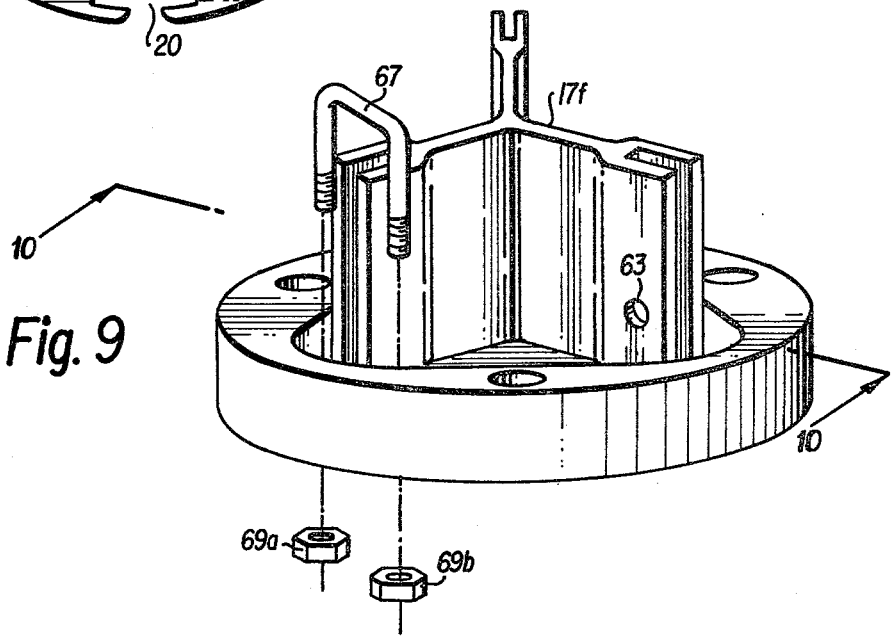
Fig. 9
Fig. 10
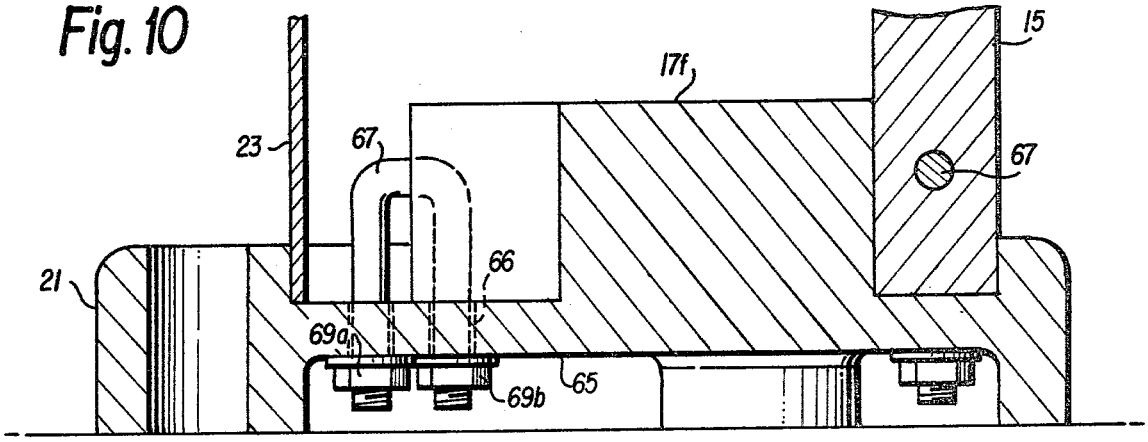

SUPPORT MEMBER AND METHOD OF MANUFACTURE

BACKGROUND OF THE INVENTION

The present invention relates to a tapered support member for disparate articles, and a method for forming the same.

In the past, tapered, metallic support members such as sign posts, telephone poles, street lamps, and the like, have been formed by spinning a length of stock material on a lathe to a desired configuration. Such spinning operations involve an excessive waste of materials, provide a slow production rate, and are an expensive mode of manufacture. Often, the spinning milling operation results in a member having relatively thin wall construction which does not offer high strength characteristics and, as a result, alternative methods of manufacturing tapered support members have been devised.

Many of the above-noted difficulties can be overcome by forming an elongated member from a rolled or pressed piece of metal which is embraced by a plurality of metallic rings or bands for holding the rolled metal to form a tapered pole. Also, the rolled metal may be joined by a full length weld seam, which must be ground flush. Compared with the extrusion of metallic members by means of extrusion dies, however, both methods are still relatively cumbersome and costly.

Other tapered structural members are formed from a plurality of extruded metal elements having longitudinal edges connected by adhesive means. The use of adhesive to interconnect the longitudinal edges of such elements, however, gives rise to expansion and contraction problems under varying weather conditions which undermine the member's structural integrity. In addition, an extrusion die with an extremely large circumscribed-circle capability is required in order to produce the elements which make up such tapered structural members and due to characteristics of the extrusion art, the wider the section the thicker the cross section must be, thereby resulting in more material usage than normally needed for strength, thus adding to cost.

Accordingly it is an object of this invention to provide a method of making a tapered support member for disparate articles which reduces excessive waste of construction materials.

A further object is to provide a method of manufacture which allows the use of aluminum, plastics, or other suitable materials, which offer more desirable strength characteristics as well as excellent resistance to corrosion.

Yet another object of this invention is to provide a tapered structural member having desirable strength characteristics under varying weather conditions.

One of the advantages of the invention about to be described is that it provides an inexpensive method of manufacturing a tapered structural member.

Another advantage of the invention is that it permits a tapered support member to be constructed from a plurality of components that are extruded from aluminum, plastics, or other suitable materials. Similarly the invention provides a method of coupling the component parts of a tapered support member so as to reduce structural problems associated with the expansion and contraction of the member under varying weather conditions.

SUMMARY

In accordance with principles of the present invention, a tapered support member is constructed from elements formed by extrusion of aluminum, or other suitable materials. The elements include elongated, strip-like sections which form an open frame when coupled by a plurality of separator fasteners for progressively spacing the sections further apart along the member's longitudinal axis so as to form wedge-shaped openings or fairing channels. The frame is closed by tapered, wedge-shaped fairing inserts adapted to engage slots formed along each longitudinal edge of the strip-like sections. Additionally, a non-tapered member is contemplated using separator fasteners which space the sections equally along the length of the member. A cap and a base are included to complete the construction of the support member. The fairing inserts may be embossed metal, colored plastic, tinted plastic, painted, anodized, or covered with reflective material thus offering a decorative nature to the support member. Additionally, if transparent or translucent inserts are used, then a lighting arrangement may be situated inside the member for decorative purposes.

BRIEF DESCRIPTION OF THE DRAWINGS

The foregoing and other objects, features, and advantages of the invention will be apparent from the following more particular description of preferred embodiments of the invention, as illustrated in the accompanying drawings. The drawings are not necessarily to scale, emphasis instead being placed on illustrating the principles of the invention.

FIG. 8C is a cross-sectional view of yet another embodiment of the FIG. 6 structure, FIG. 9 is a perspective view of a base member in combination with a separator of the type illustrated in FIG. 4; and, FIG. 10 is a cross-sectional view of the FIG. 9 structure taken along the lines 10—10 thereof and further illustrating a means for fastening the elongated strip-like sections to the base.

DETAILED DESCRIPTION OF THE PREFERRED EMBODIMENTS

Figure 1:
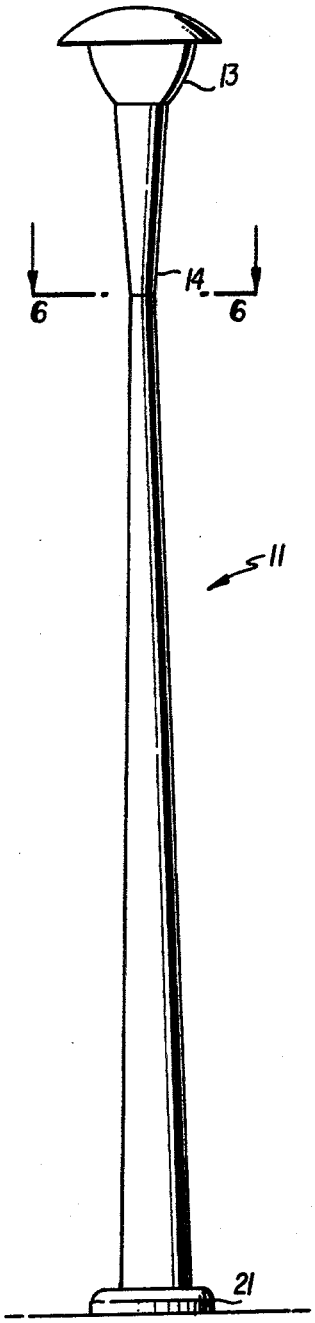
FIG. 1 is a front view of a tapered support member in the form of a light pole.

The exterior appearance of an assembled tapered support member 11 is illustrated in FIG. 1. The member 11 is employed as a light pole and is mounted on a base 21 for affixing the assembly at an intended site. A light fixture assembly 13 is mounted to the top portion 14 of the tapered support member. If desired, the support member 11 may be adapted to accommodate a variety of articles at its top portion 14 by substituting an alternative structure for the light fixture assembly 13. For example, the support member 11 can support lamps situated at the end of extended arms, as well as, illuminated signs and the like.

Figure 2A:
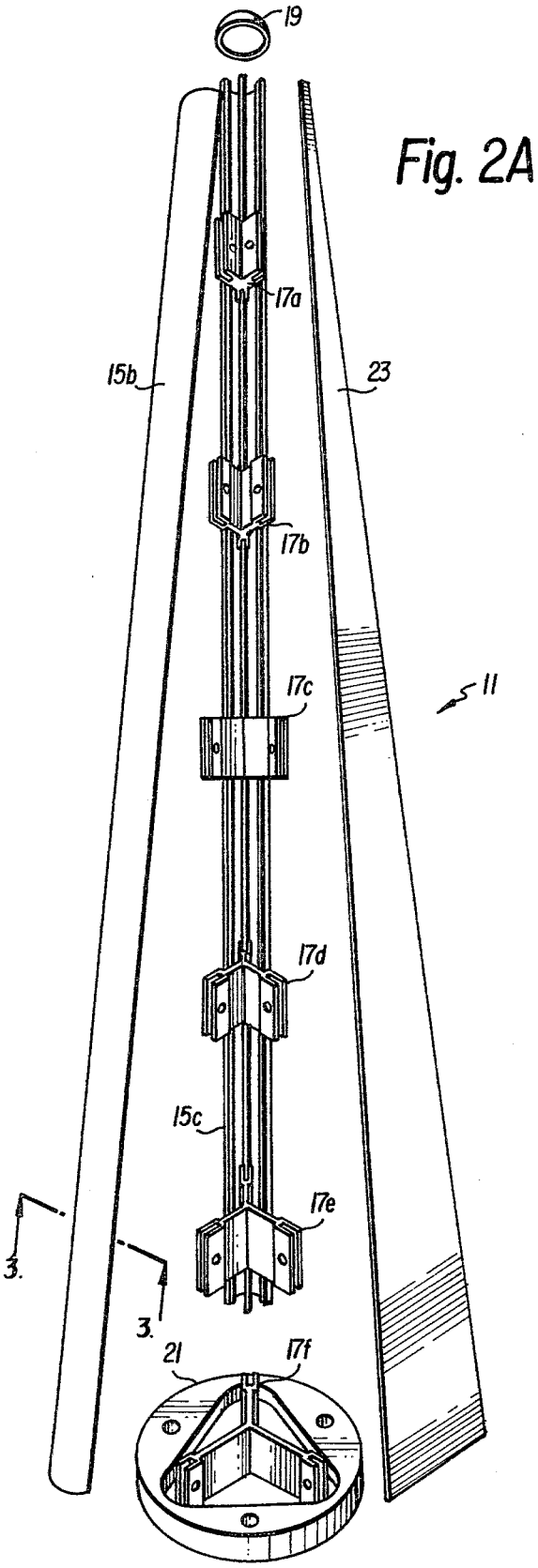
FIG. 2*a* is an exploded view of an embodiment of the present invention.
Figure 2B:
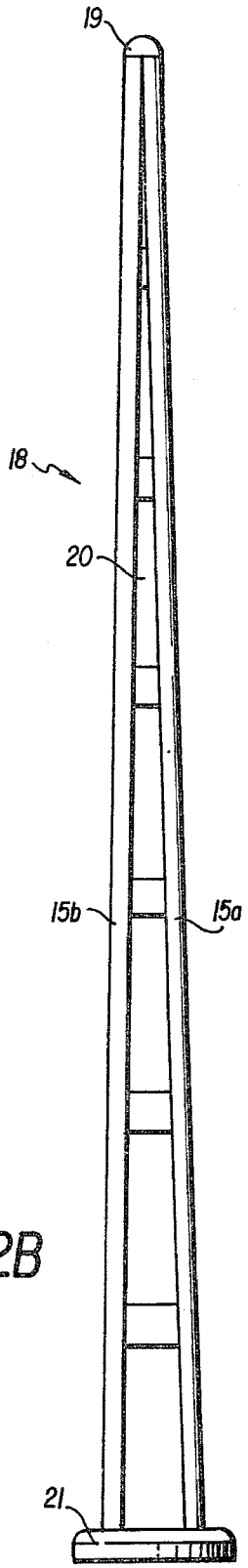
FIG. 2*b* is a side view of a tapered support member before fairing inserts are positioned in place.

Component parts of an embodiment of the support member 11 are illustrated by the exploded view offered in FIG. 2A. Basically, member 11 comprises three substantially identical elongated strip-like sections 15*a*, 15*b*, 15*c* which are coupled together by a plurality of fastener-separators in the form of spider joints 17*a*, 17*b*, 17*c*, 17*d*, 17*e*, 17*f* to form a tapered open frame 18 (FIG. 2B) having openings or fairing channels 20.

The spider joints 17 are typically spaced along the length of support member 11 and progressively diminish in size from the base 21 to the narrowest portion 14 thus providing the open frame 18 with a tapered configuration. In this respect, the narrowest portion 14 does not have to be located at the top but, if desired, can be located elsewhere on the pole. In fact, the pole can have a plurality of narrow portions. To close the open frame 18, long, tapered, wedge-shaped fairing inserts 23 are slid into the openings or fairing channels 20. The fairing inserts 23 can be embossed metal, colored plastic, clear tinted plastic, painted, anodized or covered with a reflective material; thereby offering a decorative nature to the support member 11. Using transparent or translucent inserts offers the advantage of illuminating the member from within. The clear or tinted plastic inserts 23 may also carry street signs, or the like, imprinted and illuminated from within.

A spun cap 19 is secured by pop rivets, or other suitable fasteners, to the top portion 14 and the tapered support member 11 is affixed at a desired location by attachment to the base 21 having the largest spider coupling 17*f*.

The number and spacing of separator spider joints 17 is determined by the length of the support member desired and the intended load to be supported. Typically, the spider joints 17 may be spaced 48 inches apart along the length of the member 11. This spacing offers good structural integrity.

A particular advantage offered by the present invention lies in the ability to produce the component parts of the tapered support member 11 by forcing a suitable material such as aluminum or the like through an extrusion die. The applicability of manufacture by extrusion will be apparent by examining the structure of each component part as described below.

Figure 3:
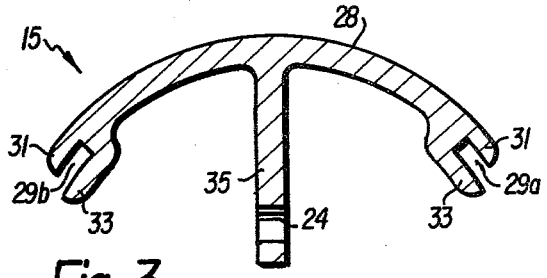
FIG. 3 is a cross-sectional view of an elongated strip-like section taken along lines 3—3 of FIG. 2*a*.

Referring to FIG. 3, a typical, strip-like section 15 comprises an arcuate surface 28 provided with slots 29*a* and 29*b* which extend the length of each longitudinal edge of the strip-like section 15. An angular or flat surface can be substituted for the arcuate surface 28 of the strip-like sections 15; thereby offering a variety of elongated support-member shapes. Each variation can be incorporated by an inexpensive change of extrusion dies. The slots 29*a* and 29*a* are formed by an outer lip 31 and an inner lip 33. The depth of the slots 29*a* and 29*b* should be as deep as possible in accordance with good extrusion practices. In order to permit easy insertion of the fairing inserts 23, the inner lip 33 is slightly longer than the outer lip 31.

Extending radially inwardly from the approximate center of the arcuate surface 28 is a web portion 35 which extends the length of the elongated strip-like section 15. The web portion 35 is provided with a plurality of holes 24 located at each spider joint coupling location along the length of the support member 11.

Figure 4:
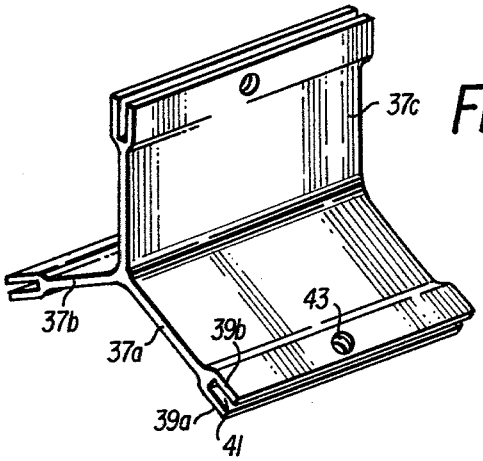
FIG. 4 is a perspective view of a separator fastener employed in the embodiment of the invention illustrated in FIG. 2*a*.

FIG. 4 illustrates a typical separator, spider joint 17. Three arms 27*a*, 27*b*, 27*c* are shown extending radially outwardly so that each is spaced approximately 120° apart. The separator spider joint 17 may include more than three arms, depending on the type of design intended. For example, a box-like cross-section could use a separator spider joint having four arms and so on. At the outward portion of each arm 27 is a pair of legs 39*a* and 39*b* which form a slot 41 adapted to engage the web portion 35 of the elongated strip-like section 15. Each leg 39*a* and 39*b*, situated at the end of the arms 37*a*, 37*b*, 37*c*, is provided with an aperture 43 to assist in coupling the spider joint 17 to the elongated strip-like sections 15 at a coupling location using a threaded bolt 25 and nut 27.

Figure 6:
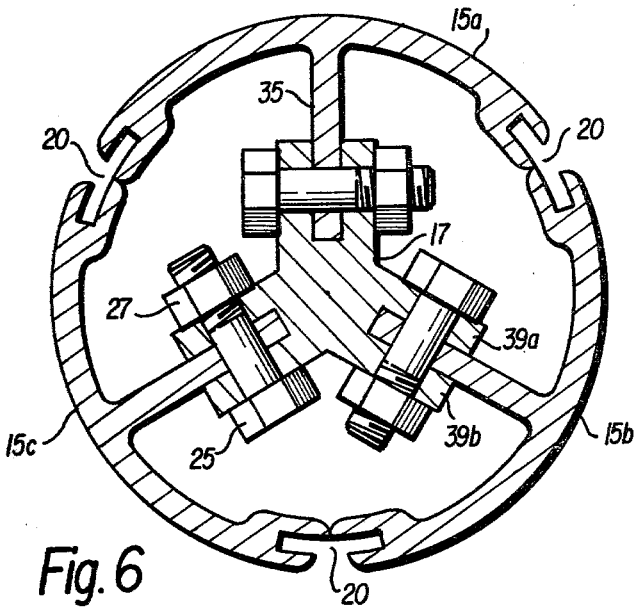
FIG. 6 is a cross-sectional view taken along the lines 6—6 of FIG. 1 with fairing sections removed.
Figure 5:
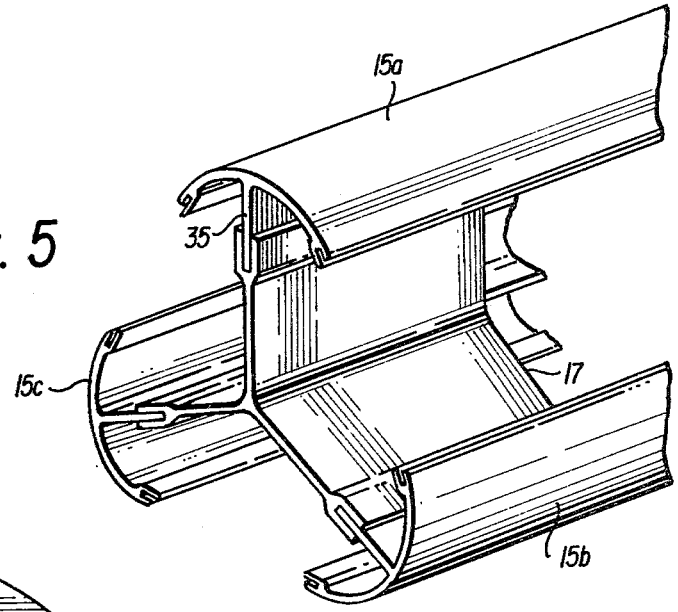
FIG. 5 is a fragmentary perspective view of a typical coupling location illustrating the formation of fairing channels.

The coupling arrangement is illustrated in FIG. 5 which provides a perspective view of a spider joint 15 situated at a coupling location along the length of the tapered support member 11. Each web portion 35 of the elongated strip-like sections 15*a*, 15*b*, 15*c* is inserted into one slot 41 of the spider joint 17 so that the hole 24 and the aperture 43 are aligned. As illustrated in FIG. 6, the threaded bolt 25 is inserted through the aligned openings and the bolt 27 is secured in place to couple the section 15 to the spider joint 17.

Figure 7:
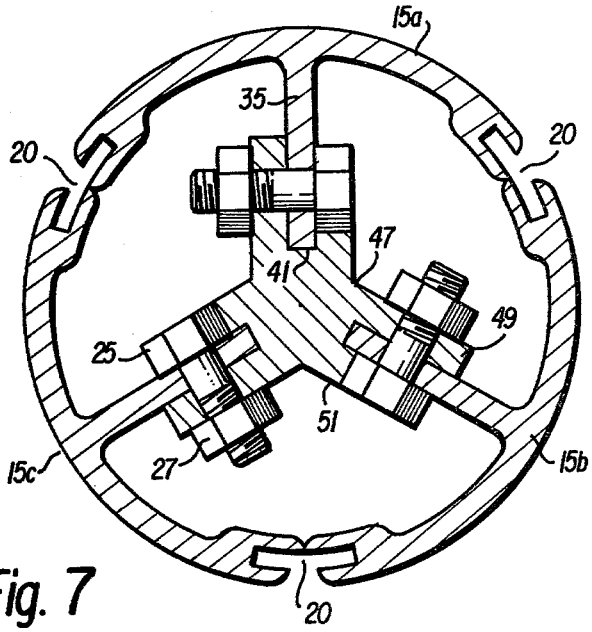
FIG. 7 is a cross-sectional view illustrating an alternate embodiment of the FIG. 6 structure.

The six legged spider joint 17 pictured in FIG. 6 offers excellent strength characteristics, but is sometimes difficult to extrude. In order to simplify production, therefor, it may be desirable to use alternative structures for the spider joint 17. For example, the production problems related to the spider joint 17 are overcome by producing a short legged spider joint 47 as illustrated in FIG. 7. Here, each slot 41 is formed by a long leg 49 having an aperture 43 and a short leg 51. The web portion 35 is inserted into the slot 41 so that openings 24 and 43 are aligned such that a bolt 25 can be inserted in place. The dimensions of the short leg 51 allow the head of the bolt 25 to abutt the end surface of the short leg 51 when nut 27 is threaded in place. This arrangement prevents the rotation of the bolt 25 during threading process.

Figure 8A:
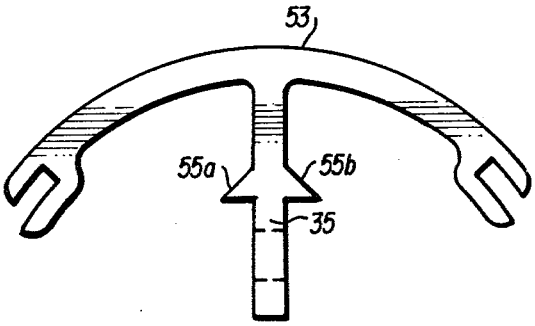
FIG. 8A is a cross-sectional view of an alternate embodiment of the FIG. 3 structure.
Figure 8B:
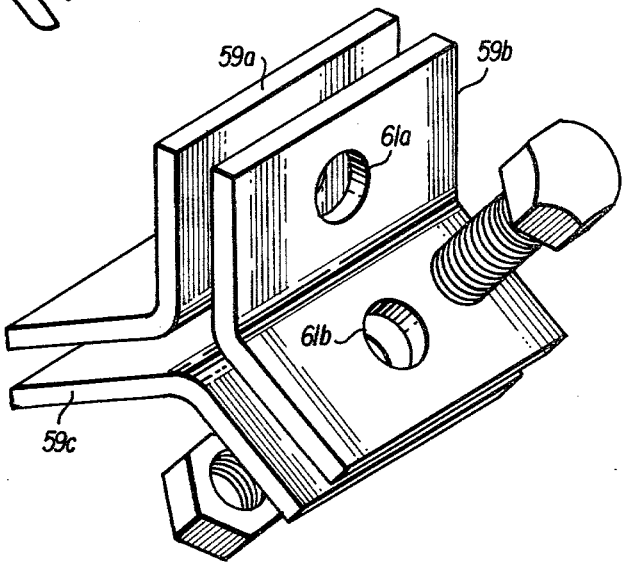
FIG. 8B is a perspective view of an alternate embodiment of the separator illustrated in FIG. 4.

Yet another embodiment is illustrated in FIGS. 8A, 8B, 8C. In FIG. 8A, a modified version of an elongated, strip-like section 53 is provided with ridges 55 and 55*b* on the web portion 35 to correctly locate a modified spider coupling 57 illustrated in FIG. 8B. The spider joint 57 comprises three V-shaped members 59*a*, 59*b*, 59*c* each provided with a pair of holes 61*a*, 61*b*. The members 59 are formed so that, when assembled as pictured in FIG. 8C, the modified spider joint 57 spaces the elongated strip-like section 53 approximately 120° apart. The ridges 55*a*, 55*b* locate the edge of each arm of the modified fastener 57 so that the openings 24 and 61 are correctly aligned allowing the insertion of the bolt 25 which couples the assembly together. Additionally, the ridges 55*a*, 55*b* prevent hinging action at the point of coupling.

After the fairing inserts 23 are placed to close the fairing channels 20, the final operation involved in the construction of the tapered support member 11 is the attachment to the base 21 as illustrated in FIG. 9. Each base 21 includes a spider coupling 17 attached to, or integrally cast with, a support 65. Where the fairing inserts 23 are made to slide up along the fairing channels 20 to permit bolting of the elongated strip-like sections 15 to the base, then holes 63 are suitably situated on spider coupling 17*f*. Alternatively, the base 65 may be provided with pairs of holes such as 66 spaced to accommodate a U-bolt 67 for attaching the elongated strip-like sections 15. Nuts 69*a*, 69*b* are used to secure the U-bolt in place as illustrated in FIG. 10.

While the invention has been particularly shown and described with reference to preferred embodiments thereof, it will be understood by those skilled in the art that various alterations in form and detail will be made therein without departing from the spirit and scope of the invention.

The embodiments of the invention which an exclusive property right or privilege is claimed is defined by the following claims:

1. A support member for disparate articles comprising:

a plurality of elongated strip-like sections coupled together by a plurality of separator-fasteners;

said separator-fasteners being operative to space said sections from one another to form an open frame having an elongate configuration and openings therein;

said open frame including fairing channels;

fairing inserts adapted to be slidably inserted into said openings for closing said open frame; and wherein each of said section includes: an outer surface which extends the length of said section;

said outer surface having longitudinal edges with slots that extend the length of said section;

a web portion extending radially inwardly from the approximate center of said outer surface; and said web portion including means to couple said strip-like sections to said separator-fasteners.

2. A support member as recited in claim 1 wherein each of said separator-fasteners comprises:

at least three arms spaced around a center portion and extending radially outwardly therefrom;

each of said arms having a pair of legs which form a slot adapted to engage said web portion of said elongated section; and each pair of said legs including means to couple said separator-fastener to a section.

3. A support member for disparate articles comprising:

a plurality of elongated strip-like sections coupled together by a plurality of separator-fasteners;

said separator-fasteners being operative to space said sections from one another to form an open frame having an elongate configuration and openings therein;

said open frame including fairing channels;

fairing inserts adapted to be slidably inserted into said openings for closing said open frame; and wherein each of said separator-fasteners comprises:

at least three arms which extend radially outwardly from a center portion;

each of said arms including a short leg and a long leg which form a slot adapted to engage said web portion of said elongated section; and said long leg including means to couple said separator-fastener to a web portion.

4. A support member for disparate articles comprising:

a plurality of elongated strip-like sections coupled together by a plurality of separator-fasteners;

said separator-fasteners being operative to space said sections from one another to form an open frame having an elongate configuration and openings therein;

said open frame including fairing channels;

fairing inserts adapted to be slidably inserted into said openings for closing said open frame; and wherein each of said separator-fasteners comprises:

at least three V-shaped plates adapted to be fastened together in the interior of said support member; and, means to affix said plates to said strip-like sections to space said strip-like sections about said interior.

5. A support member in accordance with claim 4 wherein a web portion on at least one of said elongated strip-like sections includes a ridge for locating an end of a corresponding one of said V-shaped plates.

6. A tapered support member for disparate articles comprising:

a plurality of elongated strip-like sections;

each of said sections including an arcuate surface extending the length of said section and having longitudinal slots along each edge of said arcuate surface;

a web portion extending radially inwardly from the approximate center of each of said arcuate surfaces;

a plurality of separator-fasteners;

said web portion including means to couple said strip-like sections to said separator-fasteners which progressively space said sections further apart along the length of said support member to form an open frame having a tapered configuration;

said separator-fasteners having at least three arms which extend radially outwardly from a center portion thereof;

each of said arms having a pair of legs forming a slot adapted to engage a web portion of an elongated section; and said open frame being closed by fairing inserts which engage said slots in the edges of said arcuate surfaces.

7. A tapered support member as recited in claim 6 wherein:

each of said arms includes a short leg and a long leg which form a slot adapted to engage said web portion of said elongated section; and said long leg includes means to couple said separator-fastener to a web portion.

8. A tapered support member as recited in claim 6 wherein each of said separator-fasteners comprises:

at least three V-shaped plates adapted to be fastened together in the interior of said support member; and, means to affix said plates to said strip-like sections to space said strip-like sections about said interior.

9. A tapered support member as recited in claim 6 wherein a web portion on at least one of said elongated strip-like sections includes a ridge for locating an end of a corresponding one of said V-shaped plates.

10. A tapered support member as recited in claim 6 including a base member and wherein said elongated strip-like sections are coupled to said base by U-bolts.

11. A tapered support member as recited in claim 6 wherein the component parts are produced by extruding an extrudable material through an extrusion die.

12. A tapered support member as recited in claim 11 wherein said metal includes aluminum.

* * * * *